US011707812B2

(12) United States Patent
Fox et al.

(10) Patent No.: US 11,707,812 B2
(45) Date of Patent: Jul. 25, 2023

(54) TOWEL QUICK CONNECTOR PAD

(71) Applicants: Kenneth Fox, Brentwood, CA (US); David Tedeschi, Foristell, MO (US)

(72) Inventors: Kenneth Fox, Brentwood, CA (US); David Tedeschi, Foristell, MO (US)

( * ) Notice: Subject to any disclaimer, the term of this patent is extended or adjusted under 35 U.S.C. 154(b) by 730 days.

(21) Appl. No.: 16/428,693

(22) Filed: May 31, 2019

(65) Prior Publication Data

US 2020/0376624 A1 Dec. 3, 2020

(51) Int. Cl.
*B24B 29/00* (2006.01)
*A47L 11/164* (2006.01)

(52) U.S. Cl.
CPC ..... *B24B 29/00* (2013.01); *A47L 11/164* (2013.01)

(58) Field of Classification Search
CPC .. A47L 11/14; A47L 11/4036; A47L 11/4038; A47L 13/46; A47L 11/164; A47L 11/282; A47L 11/16; A47L 11/162; B24B 29/00; B24B 23/00; B24B 45/006; B08B 1/04; B08B 1/006; B24D 13/16; B24D 9/085
USPC ..... 15/97.1, 97.2, 97.3, 230.17, 231; 451/357, 359
See application file for complete search history.

(56) References Cited

U.S. PATENT DOCUMENTS 2,280,149 A * 4/1942 Gerst ..... B24D 9/08 451/511
2,991,596 A * 7/1961 Walters ..... B24D 9/085 451/508
3,019,042 A * 1/1962 Smith ..... A47L 11/4069 403/261
3,099,855 A * 8/1963 Nash ..... A47L 13/29 15/244.2
5,461,750 A * 10/1995 Kaiser ..... A47L 11/4038 15/230
9,682,461 B2 6/2017 Givens
(Continued)

FOREIGN PATENT DOCUMENTS

JP 3107068 U * 1/2005
JP 3168289 U * 6/2011
KR 101746341 B1 6/2017

OTHER PUBLICATIONS

Translation of JP3168289U retrieved from Espacenet on Nov. 24, 2021 (Year: 2011).*

(Continued)

*Primary Examiner* — Thomas Raymond Rodgers
(74) *Attorney, Agent, or Firm* — Gary L. Eastman, Esq.; Eastman IP

(57) ABSTRACT

The present invention is an interface between an orbital or dual action machine and towels. The apparatus may directly connect to the orbital or dual action machine or may attach to a backing plate that is attached to the orbital or dual action machine. The quick connector is located concentric with the head of the orbital and dual action machine to provide balanced and even mechanical movement of the attached towel. The present invention provides an interface between an orbital or dual action machine and towels in order to take advantage of the mechanical action of the machines to provide faster and more efficient use of towels. An exemplary embodiment of the present invention is a towel quick connector pad having of a central opening with a retaining aperture for attaching and securing a towel.

8 Claims, 10 Drawing Sheets

(56) References Cited

U.S. PATENT DOCUMENTS

| | | | |
|---|---|---|---|
| 10,160,097 | B2 | 12/2018 | Krause et al. |
| 2005/0081317 | A1 | 4/2005 | Olgin et al. |

OTHER PUBLICATIONS

Translation of JP3107068U, retrieved from Google Patents on Nov. 24, 2021 (Year: 2005).*
Microfiber Buffing Pads, https://buffandshine.com/pages/microfiber-buffing-pads.
Ultimate Beginner's Guide to Buffing Pads—Fix your Paint the Right Way, https://www.theartofcleanliness.com/automotive/the-ultimate-guide-to-buffing-pads/.
Kemtex, Car Polisher Safety & Operating Instruction Manual, http://www.kemtex.be/image/data/pdf/17.200030-00_J0560_2016_manual_KEM_EN.pdf.

* cited by examiner

TOWEL QUICK CONNECTOR PAD

FIELD OF INVENTION

This invention relates to a buffing pad, and more particularly, to an interchangeable buffing pad for use with a buffing machine.

BACKGROUND OF THE INVENTION

Machines are often utilized by both professionals and novices to perform polishing and waxing. When a person is polishing or waxing by hand, the movement and power of their hands are used to apply an appropriate product to the surface, buffed, and then wiped clean. Generally, the product is applied with a foam pad or microfiber application in circular and linear motions, is buffed with a clean towel, and then wiped clean with more clean towels. Machines, such as the orbital/dual action machine replace the hand movements required to apply and buff with the mechanical action of the machines; the head of the orbital/dual action machine rotates in a circular motion and/or oscillates in a predefined path.

The orbital/dual action machine includes apparatuses that allow for the application and buffing of the product onto a surface using mechanical action. Generally, the orbital/dual action machine includes a backing plate that is removably attached to the orbital/dual action machine and pads that are removably attached to the backing plate. The backing plate include a threaded post, a mount attached to the threaded post, a flexible base attached to the mount, and either the loop or hooks of a hook and loop fastener. The pads include a flexible backing, a pad material attached to one side of the flexible backing, and the loops or hooks of a hook and loop fastener attached to the opposite side of the flexible backing. The pad is attached to the backing plate by use of the hook and loop fasteners. Machines perform the actions of applying and buffing faster and more efficiently than by hand, however the final step of wiping the surface clean is still performed by hand.

To wipe the surface clean after applying and buffing, a clean towel is used to remove the product from the surface. A towel that is saturated with product will no longer be able to remove the product from the surface and will only move the product around. Additionally, the excess product from the towel may be deposited back onto the surface, which may be contaminated and dirty. In order to properly remove the product from the surface, multiple clean towels are used. However, towels are used by hand and cannot be used with the orbital/dual action machine.

In light of the above, it would be advantageous to provide an apparatus to attach a towel to an orbital or dual action machine. It would further be advantageous for the apparatus to be able to quickly remove and replace a used towel with a new towel. It would further be advantageous to provide an apparatus that attaches to an orbital or dual action machine that includes a pad with the capability to attach a towel. It would further be advantageous for the pad to be able to quickly remove and replace a used towel with a new towel.

SUMMARY OF THE INVENTION

The present invention is a universal interface between an orbital/dual action machine and towels. The apparatus attaches to orbital/dual action machine and provides a quick connector for a towel. The apparatus may directly connect to the orbital/dual action machine or may attach to a backing plate that is attached to the orbital/dual action machine. The quick connector is located concentric with the head of the orbital/dual action machine to provide balanced and even mechanical movement of the attached towel. The present invention provides an interface between an orbital/dual action machine and towels in order to take advantage of the mechanical action of the machines to provide faster and more efficient use of towels.

In an exemplary embodiment, the present invention is a towel quick connector pad. The towel quick connector pad is a pad having a central opening with a retaining aperture for attaching and securing a towel. The pad includes a foam medium attached to a base, the base having the ability to be attached to the hook and loop fastener of a backing plate attached to an orbital or dual action machine. In the center of the foam pad is the circular retaining aperture that extends the depth of the towel quick connector pad. The aperture includes a number of retaining tabs used to securely hold a towel.

In an alternative embodiment of the present invention, the towel quick connector pad includes a pad surface for polishing, waxing, or for any other purpose. The towel quick connector pad is a pad having a central opening with a retaining aperture for attaching and securing a towel. The pad includes a pad medium attached to a base, the base having the ability to be attached to the hook and loop fastener of a backing plate attached to an orbital or dual action machine. In the center of the pad medium is the circular retaining aperture that extends the depth of the towel quick connector pad. The aperture includes a number of retaining tabs used to securely hold a towel.

In another alternative embodiment of the present invention, the towel quick connector pad is directly attached to an orbital/dual action machine. The towel quick connector pad is a pad having a central opening with a retaining aperture for attaching and securing a towel. The pad includes a pad medium attached to a base, the base having the ability to be attached to an orbital/dual action machine through a threaded post. In the center of the foam pad is the circular retaining aperture that extends a predetermined depth of the towel quick connector pad. The aperture includes a number of retaining tabs used to securely hold a towel.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

BRIEF DESCRIPTION OF THE DRAWINGS

Embodiments of this invention may best be understood by referring to the following description and accompanying drawings that are used to illustrate the invention. In the drawings.

DETAILED DESCRIPTION OF THE INVENTION

Embodiments of the present invention are described herein in the context of a towel quick connector pad. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

Figure 1:
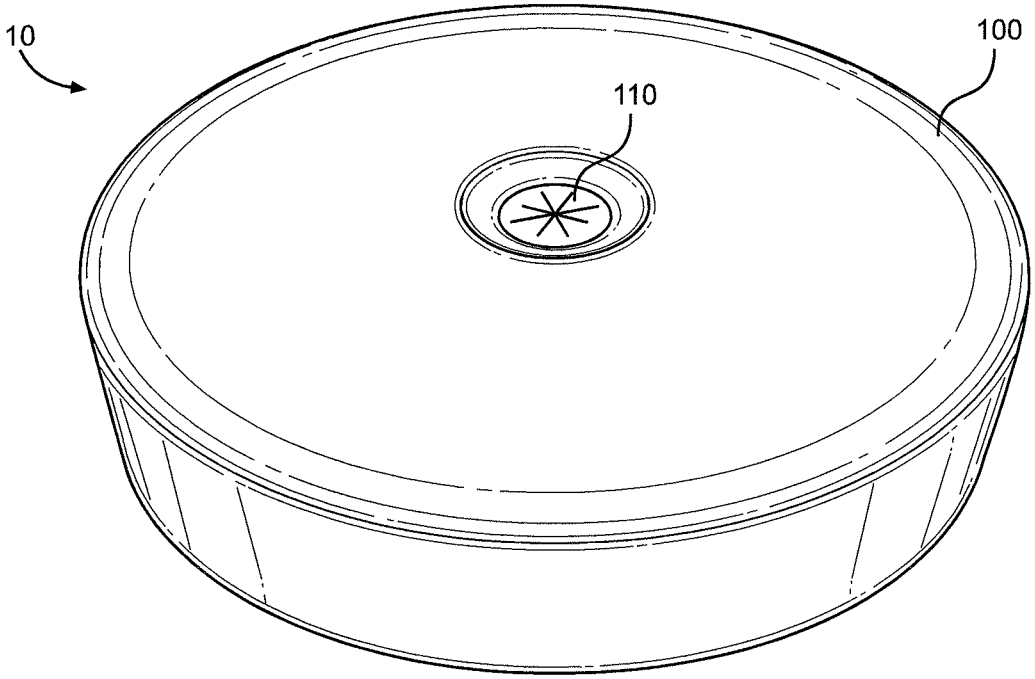
FIG. 1 is a top perspective view of the present invention, a towel quick connector pad.

Referring initially to FIG. 1, a top perspective view of a towel quick connector pad of the present invention is shown and generally designated 10. The towel quick connector pad 10, described in conjunction with FIGS. 2-6, includes a foam medium 100, an aperture 110, a base 120, and a hook and loop fastener 130. The foam medium 100 is attached to the base 120 on one side of the base 120 and the hook and loop fastener 130 is attached to the opposite side of the base 120. The aperture 110 is located concentric with the foam medium 100, the base 120, and the hook and loop fastener 130. The aperture 110 extends through the foam medium 100 and is attached to the base 120. It is contemplated that the aperture 110 is also attached to the foam medium 100. A towel 140 (shown in FIG. 7) is removably attached to the aperture 110.

Figure 2:
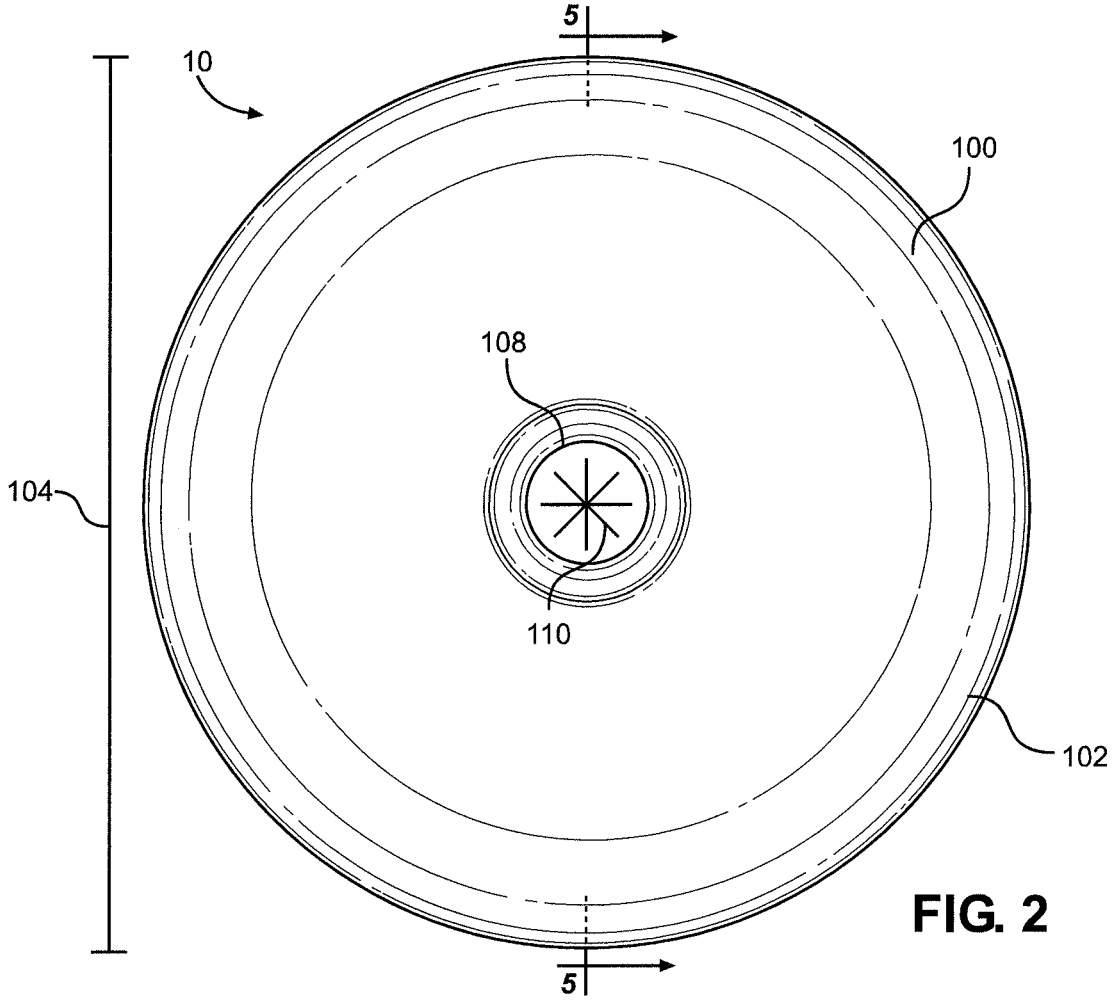
FIG. 2 is a top view of the towel quick connector pad.

Referring now to FIG. 2, a top view of the towel quick connector pad 10 is shown. The foam medium 100 includes a body 102 in the shape of a disc with a diameter 104 and thickness 106 (shown in FIG. 5). In the center of the body 102 is a bore 108 with the aperture 110 inserted within. When the towel quick connector pad 10 with attached towel 140 is used, the foam medium 100 provides an elastic body that can be distorted to accommodate surface shape variations when in use. The foam medium 100 compresses to accommodate surface irregularities and keeps the attached towel 140 in contact with the entire surface. This prevents the concentration of forces when the towel quick connector pad 10 is in use.

It is contemplated that, in an alternative embodiment of the invention, the foam medium 100 may also provide a surface that may be used to polish and wax a surface. The foam medium 100 may be made of foam with different physical properties to accommodate a user's need to polish or wax a surface. By providing a foam medium 100 capable of polishing or waxing, a user will not have to switch between the towel quick connector pad 10 and a polishing or waxing pad.

Figure 3:
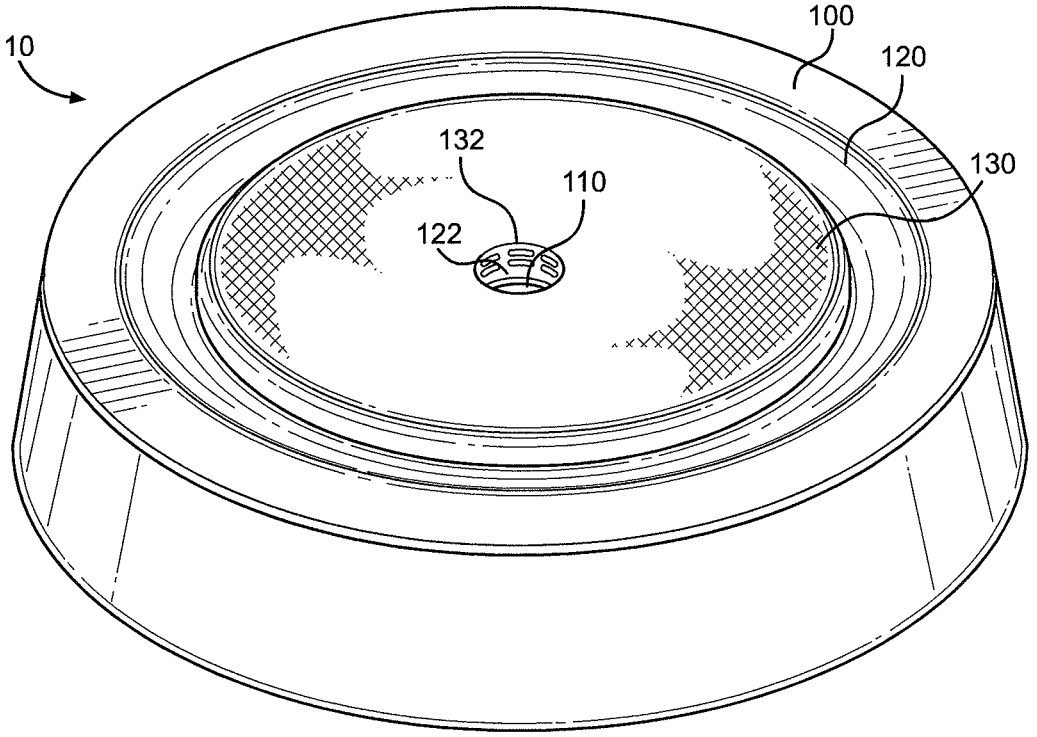
FIG. 3 is a bottom perspective view of the towel quick connector pad.

Referring now to FIG. 3, a bottom perspective view of the towel quick connector pad 10 is shown. The foam medium 100 is attached to the base 120 on one side of the base 120 and the hook and loop fastener 130 is attached to the opposite side of the base 120. A hole 122 is formed in the base 120 to provide access to the aperture 110. A hole 132 is also formed in the hook and loop fastener 130. The foam medium 100, the aperture 110, the base 120, and the hook and loop fastener are all concentric, thus the bore 108 (shown in FIG. 2), aperture 110, the hole 122, and the hole 132 are also all concentric.

Figure 4:
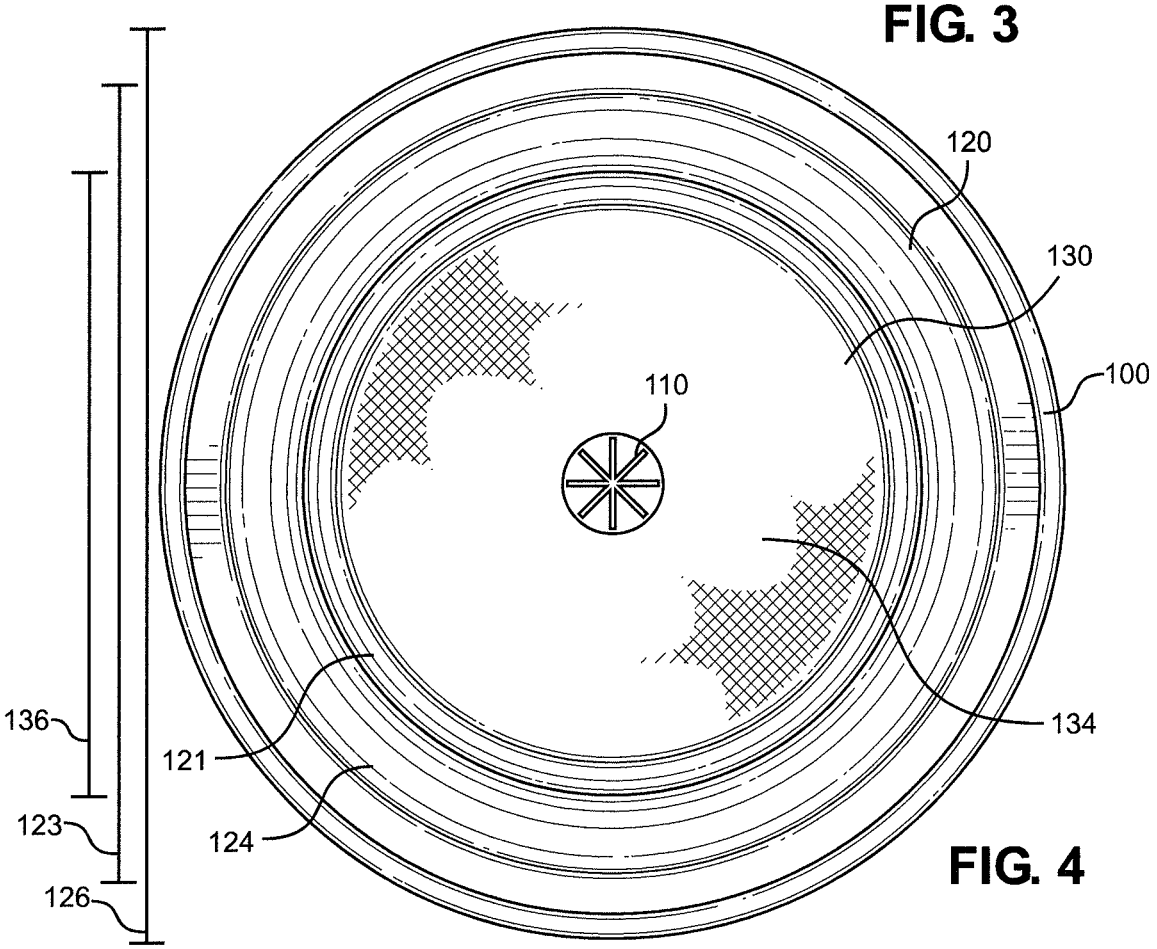
FIG. 4 is a bottom view of the towel quick connector pad.

Referring now to FIG. 4, a bottom view of the towel quick connector pad 10 is shown. The base 120 has a body 121 that is disc shaped and has a diameter 123. The body 121 includes a lip 124 extending away from the body 121. The lip 124 has an outer diameter 126 with an inner diameter equal to the diameter 123 of the body 121. The body 121 is made of a firmer material than the foam medium 100 to provide a solid surface that the foam medium 100 can compress against. Additionally, the firmer material for the base 120 provides a sturdy surface for attachment of the towel quick connector pad 10 to an orbital or dual action machine, but also has flexibility to bend when too much force is placed on the towel quick connector pad 10.

The hook and loop fastener 130 includes a body 134 in the shape of a disc with diameter 136, which is smaller than diameter 123. In the exemplary embodiment of the towel quick connector pad 10, the hook and loop fastener 130 is a series of hooks. The hook and loop fastener 130 is attached to the body 121 of the base 120 within the lip 124. On the opposite side of the base 120, the foam medium 100 is attached to the body 121 and the lip 124 of the base 120.

Figure 5:
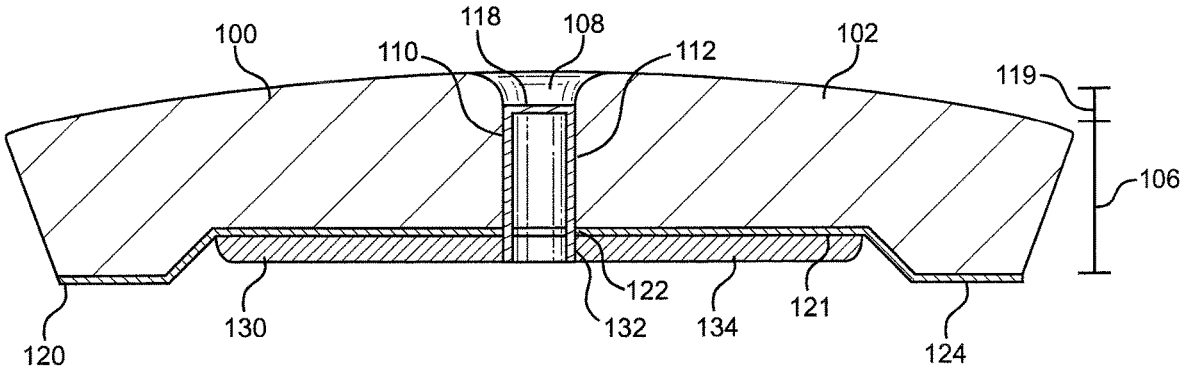
FIG. 5 is cross section view taken at line 5-5 of FIG. 2.

Referring now to FIG. 5, a cross section view of the towel quick connector pad 10 taken along lines 5-5 of FIG. 1 is shown. The hook and loop fastener 130 is attached to the body 121 of the base 120 within the lip 124. On the opposite side of the base 120, the foam medium 100 is attached to the body 121 and the lip 124 of the base 120. The aperture 110 extends through the foam medium 100 and is attached to the base 120. It is contemplated that the aperture 110 is also attached to the foam medium 100. The foam medium 100, the aperture 110, the base 120, and the hook and loop fastener are all concentric, thus the bore 108 (shown in FIG. 2), aperture 110, the hole 122, and the hole 132 are also all concentric.

Figure 6:
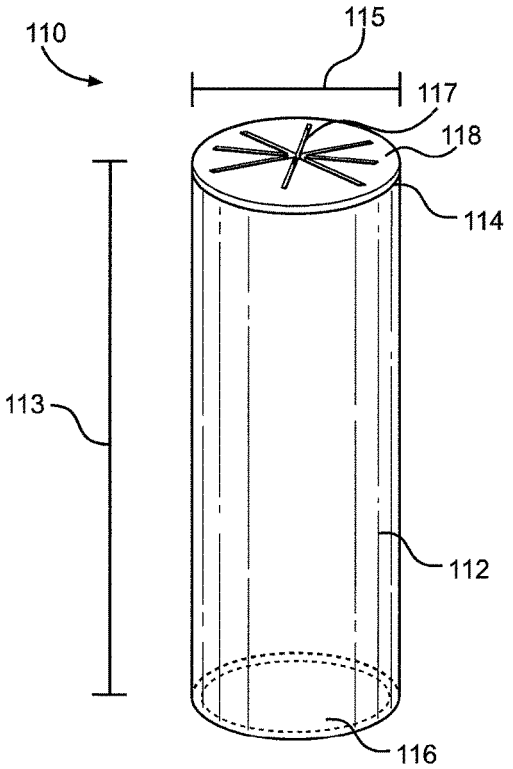
FIG. 6 is a perspective view of the aperture.

Referring now to FIG. 6, a perspective view of the aperture 110 is shown. The aperture 110 includes a body 112 formed as a tube 112 with a length 113 and a diameter 115.

The tube 112 has a top end 114 and a bottom end 116. The top end 114 includes a locking mechanism 118 and the bottom end 116 is left open. The locking mechanism 118 in the exemplary embodiment of the present invention is a series of 8 plastic tabs 117 extending inwards from the top end 114 of the tube 112. It is contemplated that any number of plastic tabs 117 may be used without departing from the spirit and scope of the invention. The plastic tabs 117 of the locking mechanism 118 do not overlap and are made of an elastic material. The plastic tabs 117 of the locking mechanism 118 bend towards the direction of an applied force.

Referring back to FIG. 5, the aperture 110 is placed within the bore 108 of the foam medium 100 and attached to the body 121 of the base 120. The length 113 of the aperture 110 is shorter than the thickness 106 of the foam medium 100 and therefore leaves a gap 119 between the locking mechanism 118 and the top surface of the foam medium 100. Since the tube 112 of the aperture 110 is more rigid than the foam medium 100, the gap 119 provides a safety margin for when the foam medium 100 is compressed at the center.

Figure 7:
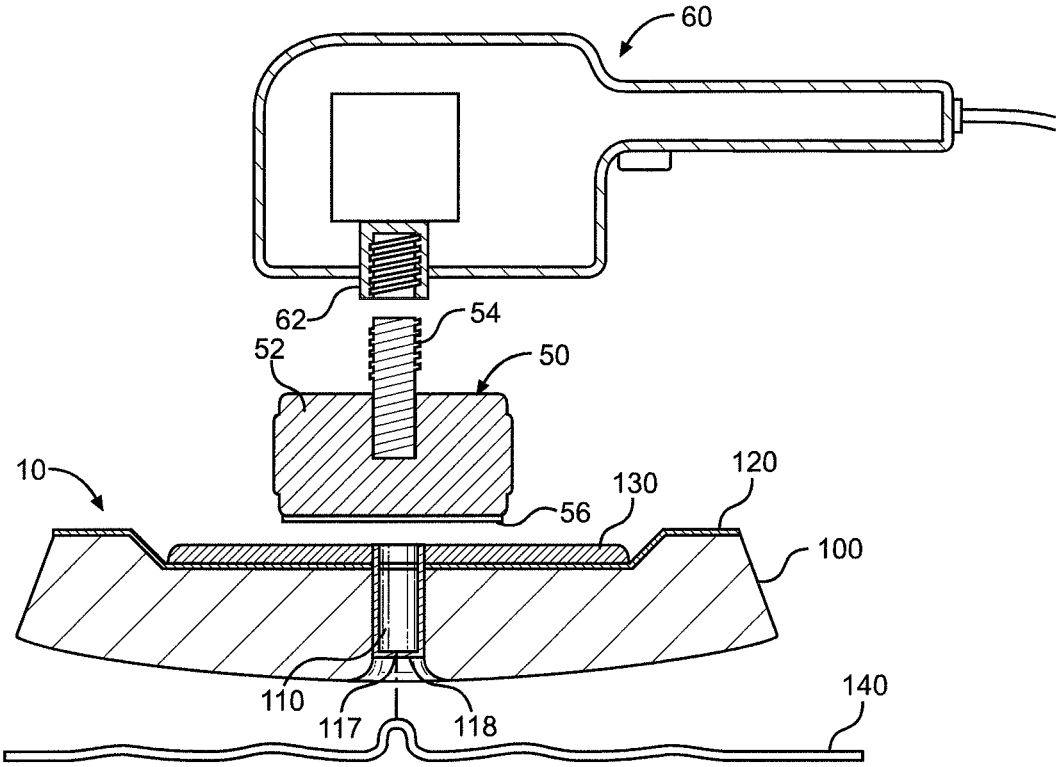
FIG. 7 is an exploded cutaway view of the towel quick connector pad attached to an orbital/dual action machine.

Referring now to FIG. 7, an exploded cutaway view of the towel quick connector pad 10 attached to a backing plate 50 attached to an orbital/dual action machine 60 is shown. The orbital/dual action machine 60 is a standard orbital/dual action machine known in the art and includes a spindle 62 for attachment of the backing plate 50. The backing plate 50 includes a body 52 with an attached threaded post 54 on one surface of the body 52 and a hook and loop fastener 56 on the opposite surface of the body 52. The hook and loop fastener 56 is a series of loops, which corresponds with the series of hooks of the hook and loop fastener 130. The threaded post 54 of the backing plate 50 is attached to the spindle 62 of the orbital/dual action machine 60.

The towel quick connector pad 10 is attached to the orbital/dual action machine 60 by attaching to the backing plate 50. The hooks of the hook and loop fastener 130 of the towel quick connector pad 10 is attached to the corresponding loops of the hook and loop fastener 56 of the backing plate 50. A towel 140 is attached to the towel quick connector pad 10 by attaching the towel 140 to the aperture 110. By placing and pressing the towel 140 in the aperture 110, the plastic tabs 117 of the locking mechanism 118 bends inwards. By pulling the towel 140 outwards the plastic tabs 117 of the locking mechanism 118 bends outwards, however, since the towel 140 is now inserted in between each plastic tab 117 of the locking mechanism 118 the towel 140 stops the plastic tabs 117 from bending completely outwards. The towel 140 provides interference between each plastic tab 117 of the locking mechanism 118 and locks the towel 140 in place. The towel quick connector pad 10 provides an interface to attach the towel 140 to the orbital/dual action machine 60.

Figure 8:
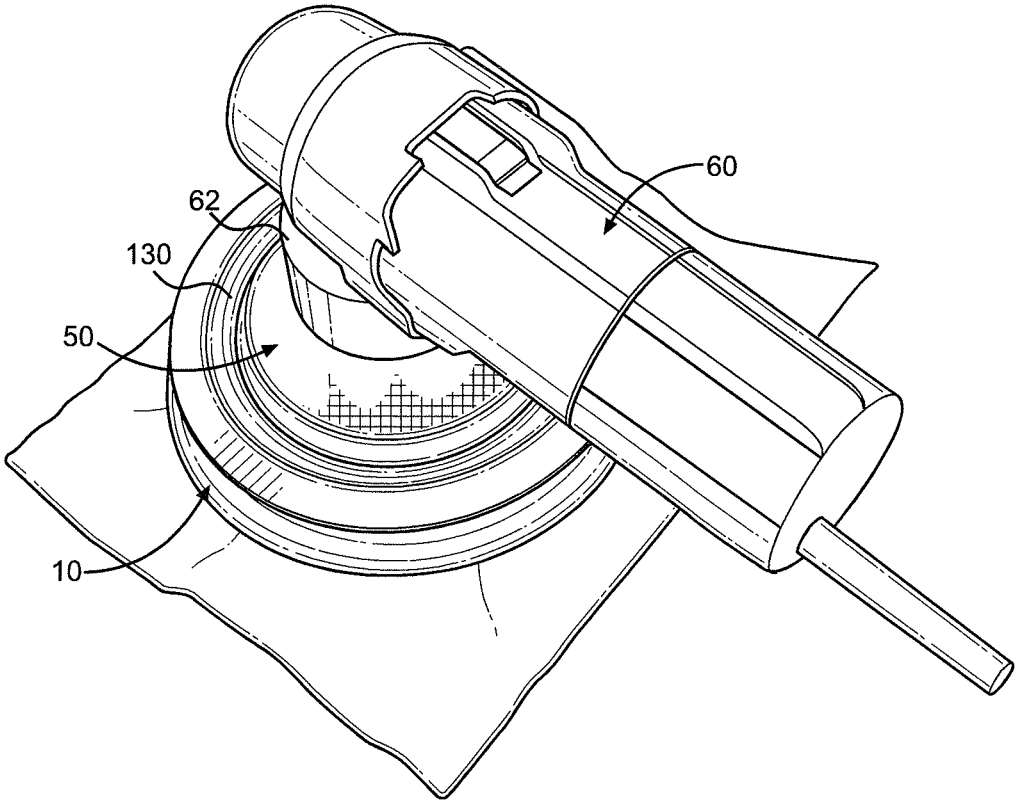
FIG. 8 is a bottom perspective view of the towel quick connector pad attached to a backing plate attached to an orbital/dual action machine.
Figure 9:
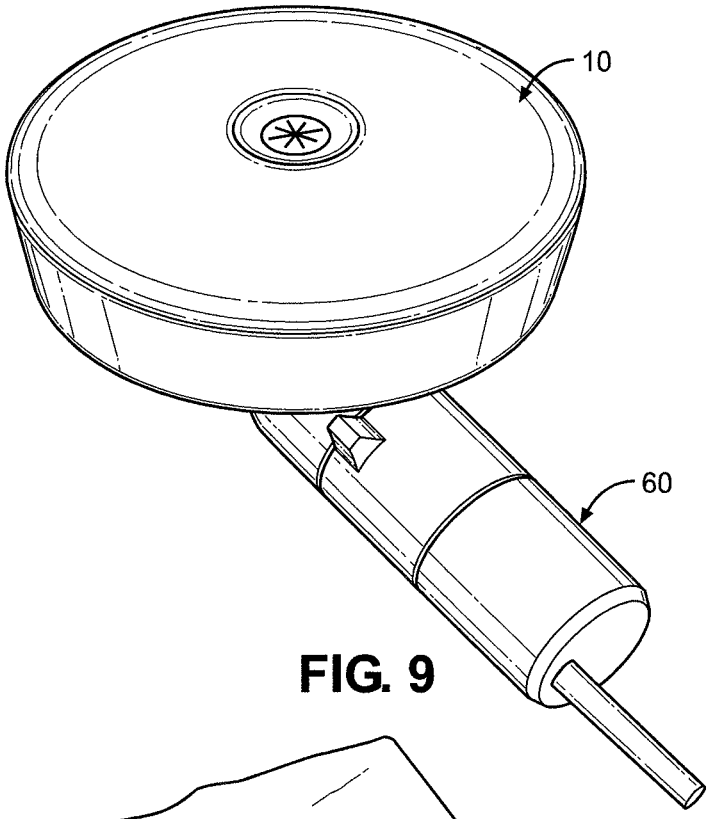
FIG. 9 is a top perspective view of the towel quick connector pad attached to the packing plate attached to the orbital/dual action machine in position to receive a towel.
Figure 10:
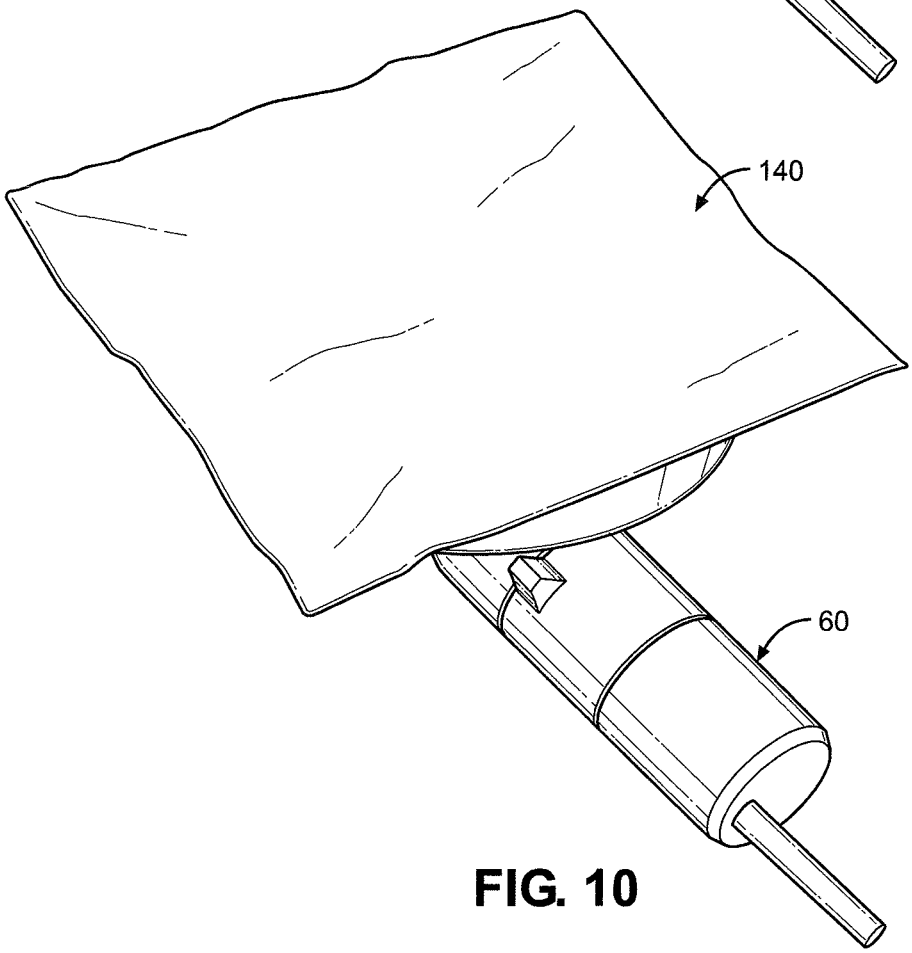
FIG. 10 is a top perspective view of the towel quick connector pad attached to the packing plate attached to the orbital/dual action machine with a towel over the towel quick connector pad.
Figure 11:
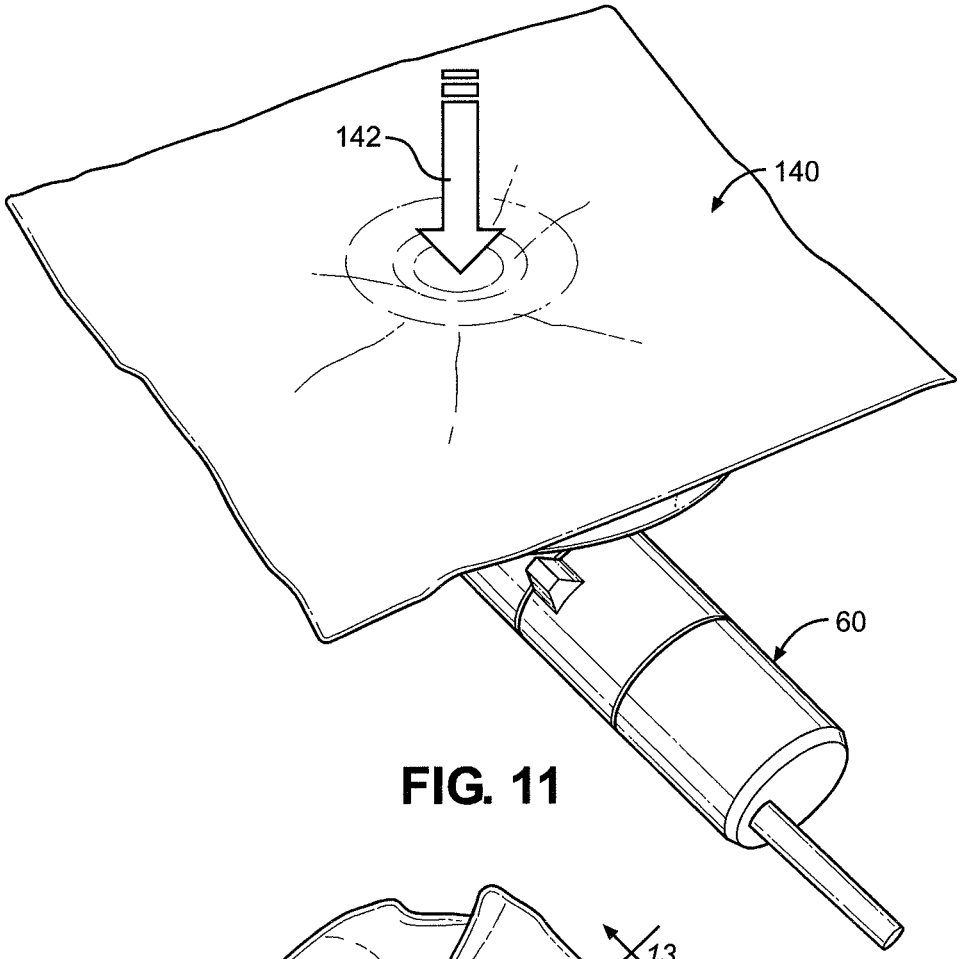
FIG. 11 is a top perspective view of the towel quick connector pad attached to the packing plate attached to the orbital/dual action machine with the towel over the towel quick connector pad and a direction of applied force to press the center of the towel into the aperture.
Figure 12:
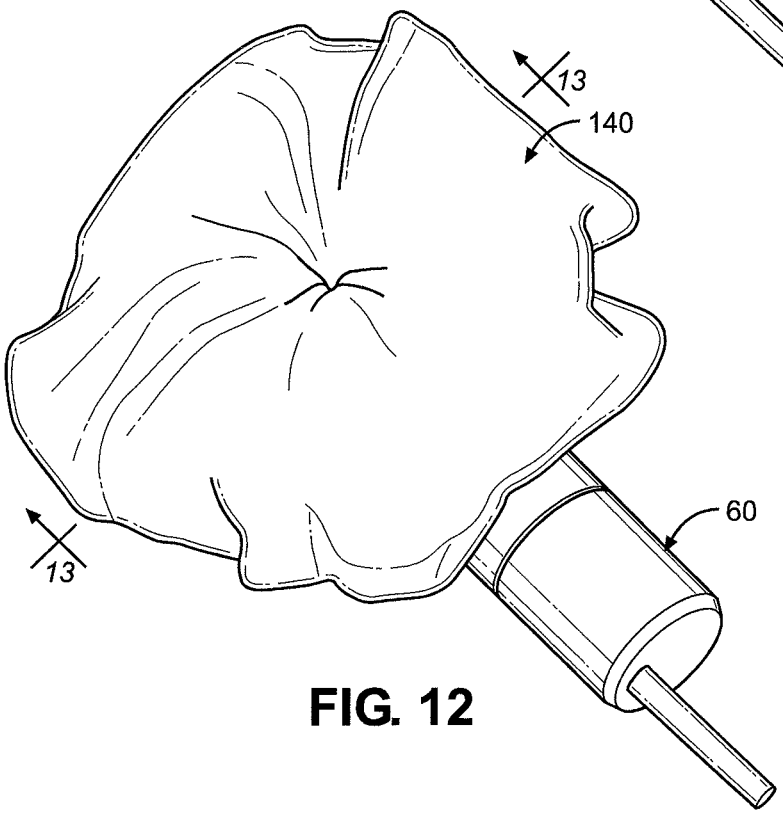
FIG. 12 is a top perspective view of the towel quick connector pad attached to the backing plate attached to the orbital/dual action machine with the towel attached to the towel quick connector pad and ready for use.

Attaching the towel 140 to the orbital/dual action machine 60 is a multi-step process and is described in conjunction with FIGS. 8-12. As shown in FIG. 8, the first step of attached the towel 140 to the orbital/dual action machine 60 is to attach the backing plate 50 to the orbital/dual action machine 60. The towel quick connector pad 10 is then attached to the backing plate 50; the hook and loop fastener 130 of the towel quick connector 10 is attached to the corresponding hook and loop fastener 52 of the backing plate 50. As shown in FIG. 9, the third step is to flip the orbital/dual action machine 60 with attached towel quick connector pad 10 so that the top of the towel quick connector pad 10 faces upward. As shown in FIG. 10, the towel 140 is placed over the towel quick connected pad 10 and centered. As shown in FIG. 11, after the towel 140 is centered on the towel quick connector pad 10 and a force 142 is applied, with a finger, a stick or other means, in the center of the towel 140 over the aperture 110. As shown in FIG. 12, the force 142 forces a portion of the towel 140 into the aperture 140 where the plastic tabs 117 of the locking mechanism 118 locks the towel 140 within the aperture. The orbital/dual action machine 60 with attached towel 140 is then ready to be used. Once the exposed surface of the towel is saturated, the towel can be pulled out of the aperture 110. The towel 140 may be flipped around so that a clean surface of the towel 140 may be used or a new towel may be used. To insert another towel, the steps are repeated.

Figure 13:
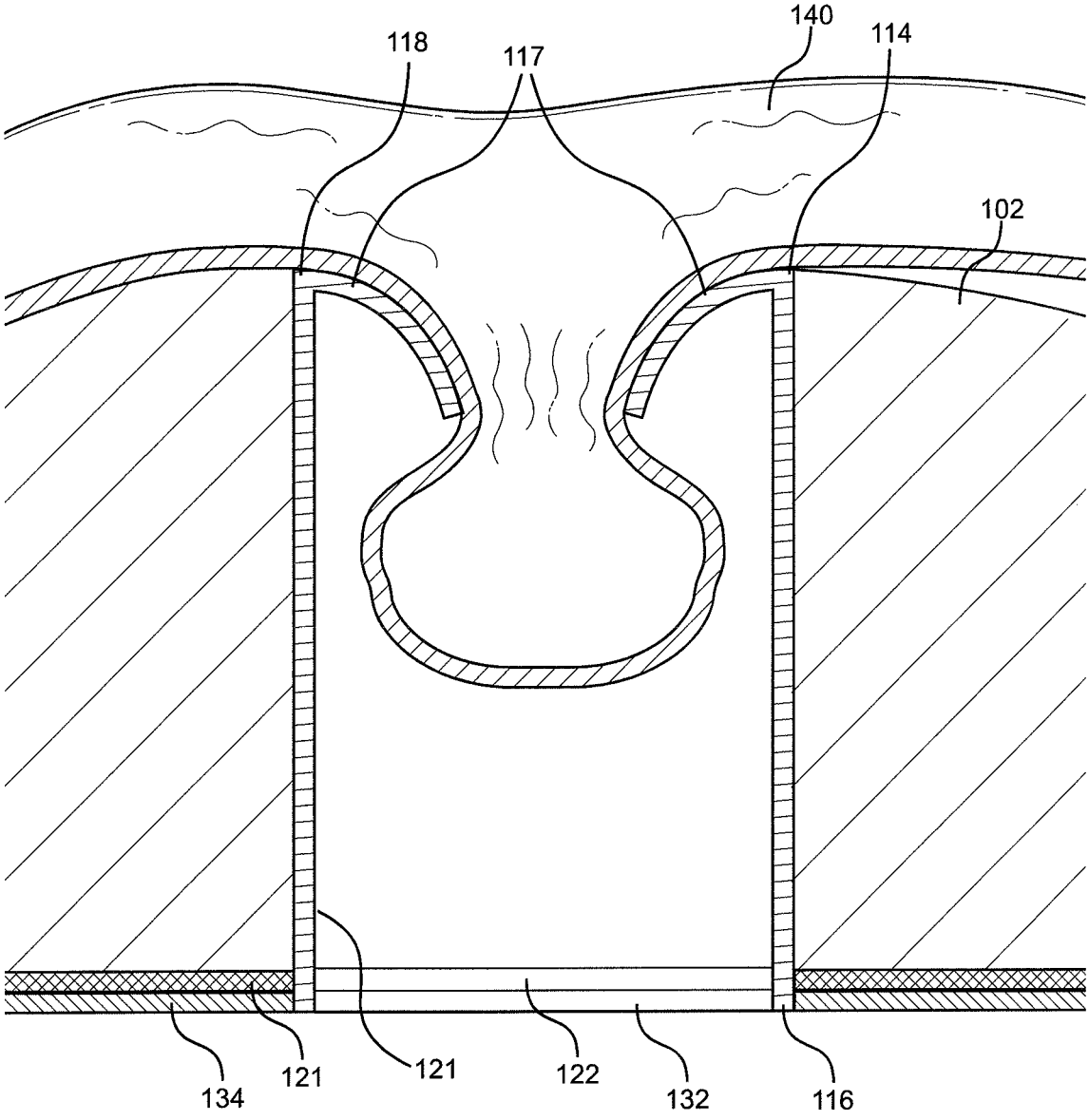
FIG. 13 is a close up view of a cross section taken at line 13-13 of FIG. 12.

Referring now to FIG. 13, a cross section view taken along line 13-13 of FIG. 12 is shown showing the towel 140 attached to the towel quick connector pad 10. The towel 140 is attached to the towel quick connector pad 10 by attaching the towel 140 to the aperture 110. By placing and pressing the towel 140 in the aperture 110, the plastic tabs 117 of the locking mechanism 118 bends inwards. A portion of the towel 140 resides in the tube 112. By pulling the towel 140 outwards the plastic tabs 117 of the locking mechanism 118 bends outwards, however, since the towel 140 is now inserted in between each plastic tab 117 of the locking mechanism 118 the towel 140 stops the plastic tabs 117 from bending completely outwards. The towel 140 provides interference between each plastic tab 117 of the locking mechanism 118 and locks the towel 140 in place. The towel quick connector pad 10 provides an interface to attach the towel 140 to the orbital/dual action machine 60.

To remove the towel 140 from the locking mechanism 118, the towel 140 may be pulled with enough force to overcome the plastic tabs 117. It is contemplated that the plastic tabs 117 provide enough elasticity to deform when pulling the towel 140 out of the locking mechanism and return to its original shape. The hole 122 of the body 121 of the base 120 and the hole 132 of the body 134 of the hook and loop fastener 130 are concentric and allows access to the tube 112. This provides access to the bottom end 116 of the tube 112 to aid in the removal of the towel 140 from the locking mechanism 118 from the top end 114 of the tube 112.

Figure 14:
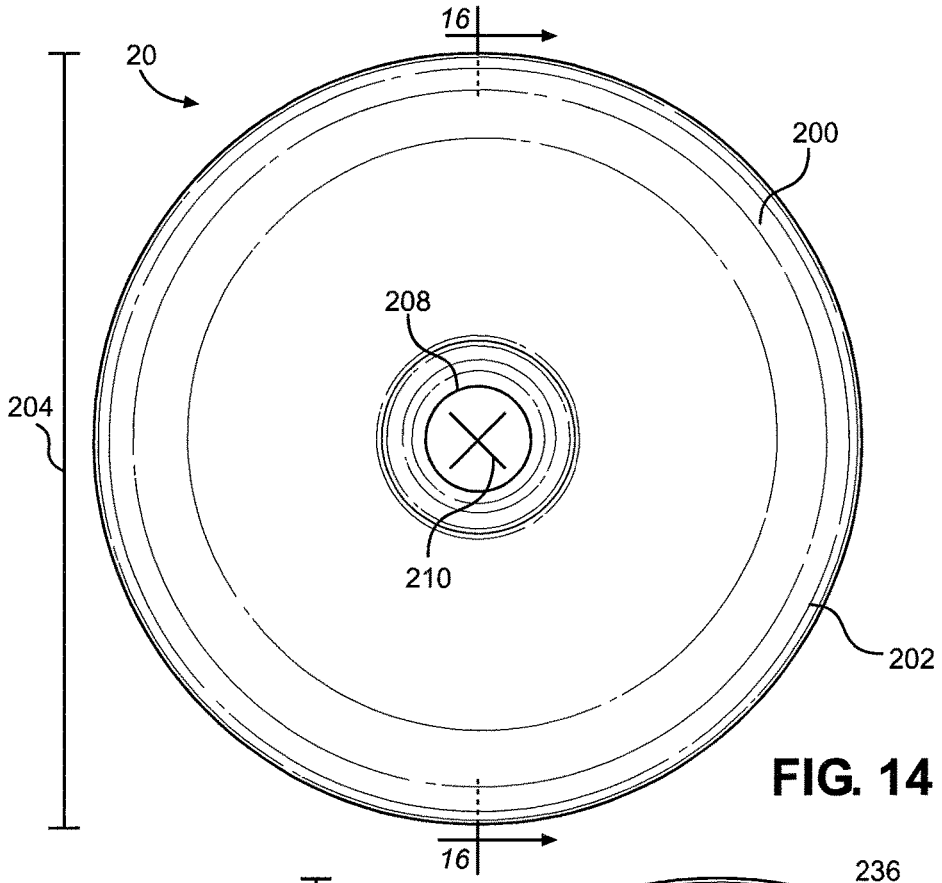
FIG. 14 is a top view of an alternative embodiment of the towel quick connector pad of the present invention.

Referring now to FIG. 14, a top view of an alternative embodiment of the towel quick connector pad of the present invention is shown and generally designated 20. The towel quick connector pad 20, described in conjunction with FIGS. 14-16, includes a foam medium 200, an aperture 210, a base 220, and a backing plate 230. The foam medium 200 is attached to the base 220 on one side of the base 220 and the backing plate 230 is attached to the opposite side of the base 220. The aperture 210 is located concentric with the foam medium 200, the base 220, and the backing plate 230. The aperture 210 extends through the foam medium 100 and is attached to the base 220. It is contemplated that the aperture 210 is also attached to the foam medium 200. The foam medium 200 includes a body 202 in the shape of a disc with a diameter 204 and thickness 206 (shown in FIG. 15). In the center of the body 202 is a bore 208 with the aperture 210 inserted within.

Figure 15:
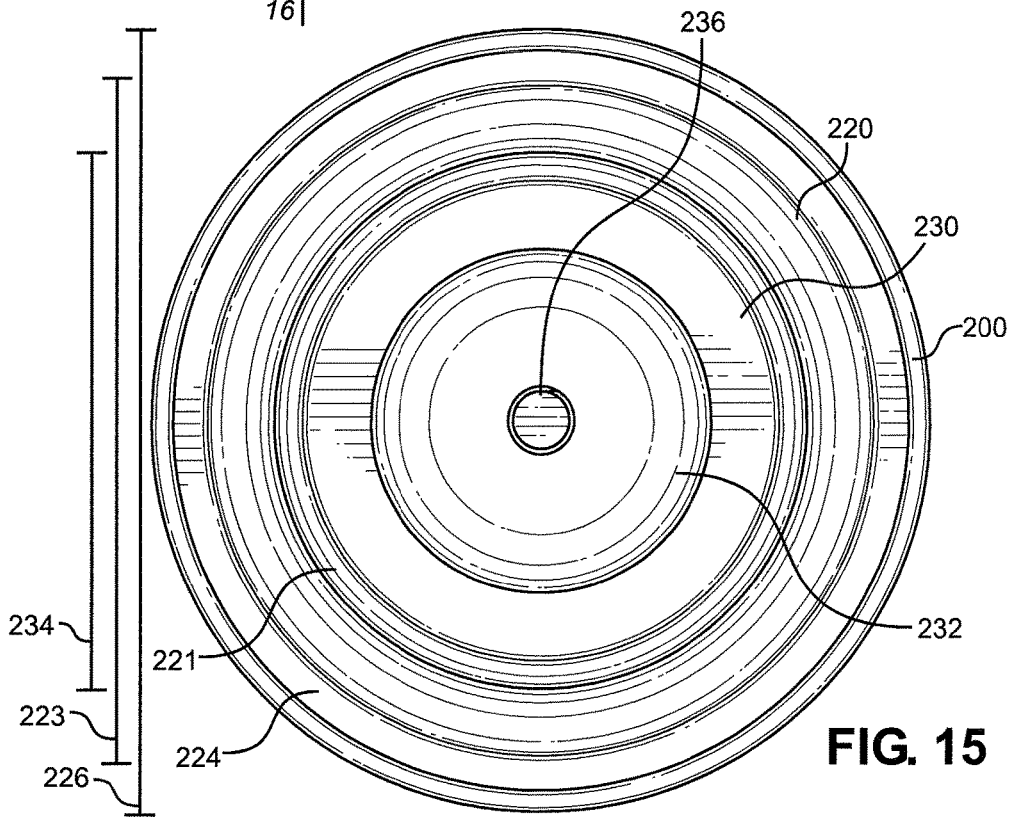
FIG. 15 is a bottom view of the alternative embodiment of the towel quick connector pad of the present invention.

Referring now to FIG. 15, a bottom view of the towel quick connector pad 20 is shown. The base 220 has a body 221 that is disc shaped and has a diameter 223. The body 221 includes a lip 224 extending away from the body 221. The lip 224 has an outer diameter 226 with an inner diameter equal to the diameter 223 of the body 221. The body 221 is made of a firmer material than the foam medium 200 to provide a solid surface that the foam medium 100 can compress against. Additionally, the firmer material for the base 220 provides a sturdy surface for attachment of the backing plate 230.

The backing plate 230 includes a body 232 in the shape of a disc with diameter 234, which is smaller than diameter 223. The body 232 of the backing plate 230 is attached to the body 221 of the base 220 within the lip 224 and on the opposite side of body 232 of the backing plate 230 a threaded post 236 is attached. The threaded post 236 is configured to attach to the spindle 62 of the orbital/dual action machine 60. On the opposite side of the base 220, the foam medium 200 is attached to the body 221 and the lip 224 of the base 220.

Figure 16:
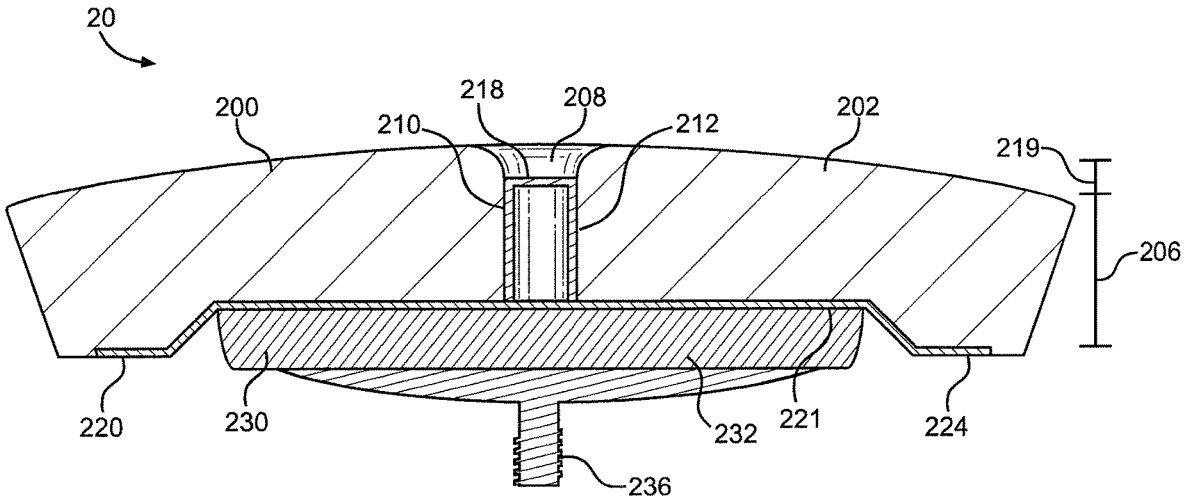
FIG. 16 is a cross section view of the alternative embodiment of the towel quick connector pad of the present invention taken along lines 16-16 of FIG. 14.

Referring now to FIG. 16, a cross section view of the towel quick connector pad 20 taken along line 16-16 of FIG. 14 is shown. The backing plate 230 is attached to the body 221 of the base 220 within the lip 224. On the opposite side of the base 220, the foam medium 200 is attached to the body 221 and the lip 224 of the base 220. The aperture 210 extends through the foam medium 200 and is attached to the base 220. It is contemplated that the aperture 210 is also attached to the foam medium 200.

Figure 17:
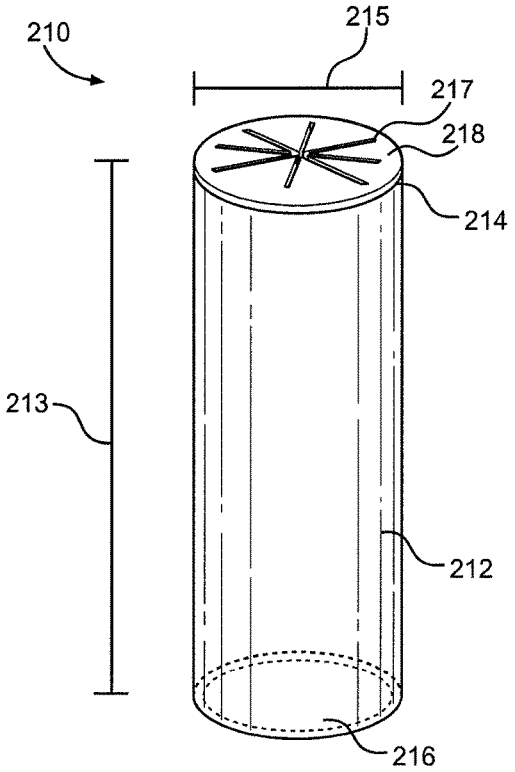
FIG. 17 is a perspective view of an alternative embodiment of the aperture of the present invention.

Referring now to FIG. 17, a perspective view of the aperture 210 is shown. The aperture 210 includes a body 212 formed as a tube 212 with a length 213 and a diameter 215. The tube 212 has a top end 214 and a bottom end 216. The top end 214 includes a locking mechanism 218 and the bottom end 216 is left open. The locking mechanism 218 is a series of plastic tabs 217 extending inwards from the top end 214 of the tube 212. The plastic tabs 217 of the locking mechanism 218 do not overlap and are made of an elastic material. The plastic tabs 217 of the locking mechanism 218 bend towards the direction of an applied force.

Referring back to FIG. 16, the aperture 210 is placed within the bore 208 of the foam medium 200 and attached to the body 221 of the base 220. The length 213 of the aperture 210 is shorter than the thickness 206 of the foam medium 200 and therefore leaves a gap 219 between the locking mechanism 218 and the top surface of the foam medium 200. Since the tube 212 of the aperture 210 is more rigid than the foam medium 200, the gap 219 provides a safety margin for when the foam medium 200 is compressed at the center.

Figure 18:
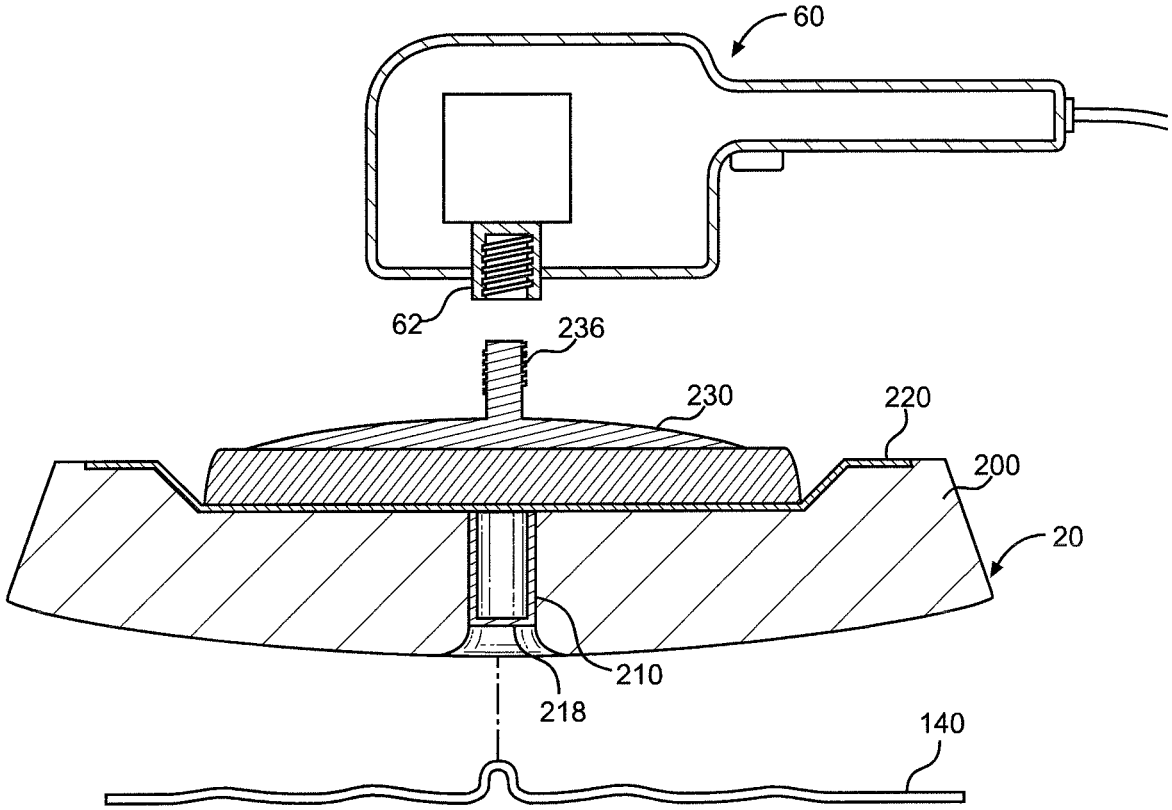
FIG. 18 is an exploded cutaway view of the alternative embodiment of the towel quick connector pad attached to an orbital/dual action machine.

Referring now to FIG. 18, an exploded cutaway view of the towel quick connector pad 20 attached to the orbital/dual action machine 60 is shown. The orbital/dual action machine 60 is a standard orbital/dual action machine known in the art and includes the spindle 62. The towel quick connector pad 20 is attached to the orbital/dual action machine 60 by attaching the threaded post 236 of the backing plate 230 of the towel connector pad 20. The towel 140 is attached to the towel quick connector pad 20 by attaching the towel 140 to the aperture 210. By placing and pressing the towel 140 in the aperture 210, the plastic tabs 217 of the locking mechanism 218 bends inwards. By pulling the towel 240 outwards the plastic tabs 217 of the locking mechanism 218 bends outwards, however, since the towel 240 is now inserted in between each plastic tab 217 of the locking mechanism 218 the towel 140 stops the plastic tabs 217 from bending completely outwards. The towel 140 provides interference between each plastic tab 217 of the locking mechanism 218 and locks the towel in place. The towel quick connector pad 20 provides an interface to attach the towel 140 to the orbital/dual action machine 60. The steps to attach and remove a towel from the towel quick connector 20 is similar to the steps for the towel quick connector 10 described herein.

While the above description contains specific details regarding certain materials, elements, components, and other teachings, it is understood that embodiments of the invention or any combination of them may be practiced without these specific details. These details should not be construed as limitations on the scope of any embodiment, but merely as exemplifications of the presently preferred embodiments. In other instances, well known structures, elements, and techniques have not been shown to clearly explain the details of the invention.

We claim:

1. A towel quick connector pad comprising:

a base configured to attach to an orbital machine;

a pad comprising a compressible foam medium attached to said base and formed with a concentric bore;

an aperture within said concentric bore and comprising a rigid tube with a locking mechanism comprising a plurality of internally projecting plastic tabs attached to said base within said bore; and a towel removably attached to said locking mechanism in said aperture, wherein said towel is flexible, thereby conforming approximately to the surface of said pad.

2. The towel quick connector pad of claim 1, further comprising a gap between a top surface of said pad and said locking mechanism of said aperture.

3. The towel quick connector pad of claim 1, wherein said tube of said aperture, said bore of said foam medium, and said base center hole of said base are concentric.

4. The towel quick connector pad of claim 1 further comprising a hook and loop fastener attached to base opposite of said foam medium.

5. The towel quick connector pad of claim 4, wherein said hook and loop fastener includes a hook and loop fastener center hole, said hook and loop fastener center hole is concentric with said tube of said aperture, said bore of said foam medium, and said base center hole of said base.

6. The towel quick connector pad of claim 5, wherein said hook and loop fastener center hole and said base center hole of said base provides access to said locking mechanism of said aperture.

7. The towel quick connector pad of claim 1 further comprising a backing plate attached to said body of said base opposite of said foam medium.

8. The towel quick connector pad of claim 7, wherein said backing plate comprises a backing plate body with an attached threaded post, said threaded post is concentric with said tube of said aperture, said bore of said foam medium, and said base center hole of said base.

* * * * *